US006591608B2

(12) United States Patent
Langenfeld et al.

(10) Patent No.: US 6,591,608 B2
(45) Date of Patent: Jul. 15, 2003

(54) FOLDED GUIDE LINK DRIVE IMPROVEMENTS

(75) Inventors: Christopher C. Langenfeld, Nashua, NH (US); Thomas Q. Gurski, Goffstown, NH (US); Stanley B. Smith, III, Raymond, NH (US)

(73) Assignee: New Power Concepts LLC, Manchester, NH (US)

( * ) Notice: Subject to any disclaimer, the term of this patent is extended or adjusted under 35 U.S.C. 154(b) by 38 days.

(21) Appl. No.: 09/883,080

(22) Filed: Jun. 15, 2001

(65) Prior Publication Data

US 2001/0049939 A1 Dec. 13, 2001

Related U.S. Application Data

(63) Continuation-in-part of application No. 09/335,392, filed on Jun. 17, 1999, now Pat. No. 6,253,550.

(51) Int. Cl.[7] ..... F01B 29/10
(52) U.S. Cl. ..... 60/517; 92/165 R
(58) Field of Search ..... 60/517, 518, 525; 92/165 R, 166, 138

(56) References Cited

U.S. PATENT DOCUMENTS

| | | | | |
|---|---|---|---|---|
| 55,516 A | | 6/1866 | Winans et al. | |
| 120,222 A | | 10/1871 | Van Emon | |
| 124,805 A | | 3/1872 | Fryer | |
| 321,313 A | | 6/1885 | Pinkham | |
| 488,373 A | | 12/1892 | Touch | |
| 1,089,651 A | | 3/1914 | Kovalavich | |
| 1,769,375 A | | 7/1930 | Leary | |
| 1,840,389 A | | 1/1932 | Eubank | |
| 1,866,702 A | | 7/1932 | Gehres | |
| 2,170,099 A | | 8/1939 | Stubings | 123/56 |
| 3,059,418 A | | 10/1962 | Johnston | 60/24 |
| 3,431,788 A | | 3/1969 | du Pré | 74/44 |
| 3,861,223 A | | 1/1975 | Braun et al. | 74/44 |
| 3,924,477 A | | 12/1975 | Portelance | 74/44 |
| 4,020,635 A | | 5/1977 | Joynes et al. | 60/525 |
| 4,169,692 A | | 10/1979 | McDonough et al. | 415/115 |
| 4,330,992 A | | 5/1982 | Senft | 60/518 |
| 4,898,041 A | | 2/1990 | Islas | 74/44 |
| 5,494,135 A | * | 2/1996 | Brackett | 123/197.4 |
| 5,761,985 A | * | 6/1998 | Stoll | 92/165 PR |
| 5,771,694 A | | 6/1998 | Houtman et al. | 60/517 |
| 5,920,133 A | | 7/1999 | Penswick et al. | 310/17 |
| 6,253,550 B1 | * | 7/2001 | Langenfeld et al. | 60/518 |

FOREIGN PATENT DOCUMENTS

| | | |
|---|---|---|
| DE | 445033 | 12/1922 |
| DE | 40 18943 A1 | 12/1991 |
| DE | 40 18 943 A 1 | 12/1991 |
| DE | 42 05 283 A1 | 8/1993 |
| DE | 42 05 283 A 1 | 8/1993 |
| FR | 2.067.119 | 8/1971 |
| FR | 2 067 119 | 8/1971 |
| FR | 2 721 982 A1 | 1/1996 |
| FR | 2 721 982 | 5/1996 |
| WO | WO 00/79114 A1 | 12/2000 |

OTHER PUBLICATIONS

International Search Report, PCT/US00/01931, dated Apr. 27, 2000.

* cited by examiner

*Primary Examiner*—Hoang Nguyen
(74) *Attorney, Agent, or Firm*—Bromberg & Sunstein LLP

(57) ABSTRACT

A system for supporting lateral loads on a piston undergoing reciprocating motion along a longitudinal axis in a cylinder includes a guide link for coupling the piston to a crankshaft undergoing rotary motion about a rotation axis of the crankshaft where the longitudinal axis and the rotation axis are substantially orthogonal to each other. A first guide element is located along the length of the guide link and includes a spring mechanism for urging the first guide element into contact with the guide link. The spring mechanism includes a first spring with a first natural frequency of oscillation and a second spring with a second natural frequency of oscillation. A second guide element is in opposition to the first guide element.

12 Claims, 12 Drawing Sheets

FOLDED GUIDE LINK DRIVE IMPROVEMENTS

PRIORITY

The present application is a continuation-in-part of U.S. patent application Ser. No. 09/335,392, filed Jun. 17, 1999, which is herein incorporated by reference.

TECHNICAL FIELD

The present invention pertains to improvements to an engine and more particularly to improvements relating to mechanical components of a Stirling cycle heat engine or refrigerator which contribute to increased engine operating efficiency and lifetime.

BACKGROUND OF THE INVENTION

Stirling cycle machines, including engines and refrigerators, have a long technological heritage, described in detail in Walker, *Stirling Engines*, Oxford University Press (1980), herein incorporated by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression. The Stirling cycle refrigerator is also the mechanical realization of a thermodynamic cycle which approximates the ideal Stirling thermodynamic cycle. In an ideal Stirling thermodynamic cycle, the working fluid undergoes successive cycles of isovolumetric heating, isothermal expansion, isovolumetric cooling and isothermal compression. Practical realizations of the cycle, wherein the stages are neither isovolumetric nor isothermal, are within the scope of the present invention and may be referred to within the present description in the language of the ideal case without limitation of the scope of the invention as claimed. Various aspects of the present invention apply to both Stirling cycle engines and Stirling cycle refrigerators, which are referred to collectively as Stirling cycle machines in the present description and in any appended claims.

The principle of operation of a Stirling engine is readily described with reference to FIGS. 1*a*–1*e*, wherein identical numerals are used to identify the same or similar parts. Many mechanical layouts of Stirling cycle machines are known in the art, and the particular Stirling engine designated generally by numeral 10 is shown merely for illustrative purposes. In FIGS. 1*a* to 1*d*, piston 12 and a displacer 14 move in phased reciprocating motion within cylinders 16 which, in some embodiments of the Stirling engine, may be a single cylinder. Typically, a displacer 14 does not have a seal. However, a displacer 14 with a seal (commonly known as an expansion piston) may be used. Both a displacer without a seal or an expansion piston will work in a Stirling engine in an "expansion" cylinder. A working fluid contained within cylinders 16 is constrained by seals from escaping around piston 12 and displacer 14. The working fluid is chosen for its thermodynamic properties, as discussed in the description below, and is typically helium at a pressure of several atmospheres. The position of displacer 14 governs whether the working fluid is in contact with hot interface 18 or cold interface 20, corresponding, respectively, to the interfaces at which heat is supplied to and extracted from the working fluid. The supply and extraction of heat is discussed in further detail below. The volume of working fluid governed by the position of the piston 12 is referred to as compression space 22.

During the first phase of the engine cycle, the starting condition of which is depicted in FIG. 1*a*, piston 12 compresses the fluid in compression space 22. The compression occurs at a substantially constant temperature because heat is extracted from the fluid to the ambient environment. In practice, a cooler (not shown) is provided. The condition of engine 10 after compression is depicted in FIG. 1*b*. During the second phase of the cycle, displacer 14 moves in the direction of cold interface 20, with the working fluid displaced from the region of cold interface 20 to the region of hot interface 18. This phase may be referred to as the transfer phase. At the end of the transfer phase, the fluid is at a higher pressure since the working fluid has been heated at constant volume. The increased pressure is depicted symbolically in FIG. 1*c* by the reading of pressure gauge 24.

During the third phase (the expansion stroke) of the engine cycle, the volume of compression space 22 increases as heat is drawn in from outside engine 10, thereby converting heat to work. In practice, heat is provided to the fluid by means of a heater (not shown). At the end of the expansion phase, compression space 22 is full of cold fluid, as depicted in FIG. 1*d*. During the fourth phase of the engine cycle, fluid is transferred from the region of hot interface 18 to the region of cold interface 20 by motion of displacer 14 in the opposing sense. At the end of this second transfer phase, the fluid fills compression space 22 and cold interface 20, as depicted in FIG. 1*a*, and is ready for a repetition of the compression phase. The Stirling cycle is depicted in a P-V (pressure-volume) diagram as shown in FIG. 1*e*.

Additionally, on passing from the region of hot interface 18 to the region of cold interface 20, the fluid may pass through a regenerator (not shown). The regenerator may be a matrix of material having a large ratio of surface area to volume which serves to absorb heat from the fluid when it enters hot from the region of hot interface 18 and to heat the fluid when it passes from the region of cold interface 20.

The principle of operation of a Stirling cycle refrigerator can also be described with reference to FIGS. 1*a*–1*e*, wherein identical numerals are used to identify the same or similar parts. The differences between the engine described above and a Stirling machine employed as a refrigerator are that compression volume 22 is typically in thermal communication with ambient temperature and expansion volume 24 is connected to an external cooling load (not shown). Refrigerator operation requires net work input.

Stirling cycle engines have not generally been used in practical applications, and Stirling cycle refrigerators have been limited to the specialty field of cryogenics, due to several daunting engineering challenges to their development. These involve such practical considerations as efficiency, vibration, lifetime, and cost. The instant invention addresses these considerations.

A major problem encountered in the design of certain engines, including the compact Stirling engine, is that of the friction generated by a sliding piston resulting from misalignment of the piston in the cylinder and lateral forces exerted on the piston by the linkage of the piston to a rotating crankshaft. In a typical prior art piston-crankshaft configuration such as that depicted in FIG. 2, a piston 10 executes reciprocating motion along longitudinal direction 12 within cylinder 14. Piston 10 is coupled to an end of connecting rod 16 at a pivot such as a pin 18. The other end 20 of connecting rod 16 is coupled to a crankshaft 22 at a fixed distance 24 from the axis of rotation 26 of the crankshaft. As crankshaft 22 rotates about the axis of rotation 26, the connecting rod end 20 connected to the crankshaft traces a circular path while the connecting rod end 28 connected to the piston 10 traces a linear path 30. The connecting rod angle 32, defined by the connecting rod longitudinal axis 34 and the axis 30 of the piston, will vary as the crankshaft rotates. The maximum connecting rod angle will depend on the connecting rod offset on the crankshaft and on the length of the connecting rod. The force transmitted by the connecting rod may be decomposed into a longitudinal component 38 and a lateral component 40, each acting through pin 18 on piston 10. Minimizing the maximum connecting rod angle 32 will decrease the lateral forces 40 on the piston and thereby reduce friction and increase the mechanical efficiency of the engine. The maximum connecting rod angle can be minimized by decreasing the connecting rod offset 24 on the crankshaft 22 or by increasing the connecting rod length. However, decreasing the connecting rod offset on the crankshaft will decrease the stroke length of the piston and result in less Δ (pV) work per piston cycle. Increasing the connecting rod length can not reduce the connecting rod angle to zero but does increase the size of the crankcase resulting in a less portable and compact engine.

Referring now to the prior art engine configuration of FIG. 3, it is known that in order to reduce the lateral forces on the piston, a guide link 42 may be used as a guidance system to take up lateral forces while keeping the motion of piston 10 constrained to linear motion. In a guide link design, the connecting rod 16 is replaced by the combination of guide link 42 and a connecting rod 16. Guide link 42 is aligned with the wall 44 of piston cylinder 14 and is constrained to follow linear motion by two sets of rollers or guides, forward rollers 46 and rear rollers 48. The end 50 of guide link 42 is connected to connecting rod 16 which is, in turn, connected to crankshaft 22 at a distance offset from the rotational axis 26 of the crankshaft. Guide link 42 acts as an extension of piston 10 and the lateral forces on the piston that would normally be transmitted to cylinder walls 44 are instead taken up by the two sets of rollers 46 and 48. Both sets of rollers 46 and 48 are required to maintain the alignment of guide link 42 and to take up the lateral forces being transmitted to the guide link by the connecting rod. The distance d between the forward set of rollers and the rear set of rollers may be reduced to decrease the size of the crankcase (not shown). However, reducing the distance between the rollers will increase the lateral load 54 on the forward set of rollers since the rear roller set acts as a fulcrum 56 to a lever 58 defined by the connection point 52 of the guide link and connecting rod 16.

The guide link will generally increase the size of the crankcase because the guide link must be of sufficient length that when the piston is at its maximum extension into the piston cylinder, the guide link extends beyond the piston cylinder so that the two sets of rollers maintain contact and alignment with the guide link.

SUMMARY OF THE INVENTION

In accordance with one aspect of the invention, a system for supporting lateral loads on a piston undergoing reciprocating motion along a longitudinal axis in a cylinder includes a guide link coupling the piston to a crankshaft undergoing rotary motion about a rotation axis of the crankshaft. A first guide element is located along the length of the guide link and includes a spring mechanism for urging the first guide element into contact with the guide link. The spring mechanism includes a first spring with a first natural frequency of oscillation and a second spring with a second natural frequency of oscillation. A second guide element is in opposition to the first guide element. In one embodiment, the first guide element is a roller having a rim in rolling contact with the guide link and the second guide element is a roller with a rim in rolling contact with the guide link.

In a further embodiment, the second guide element includes a precision positioner for positioning the second guide element with respect to the longitudinal axis. The precision positioner may be a vernier mechanism having an eccentric shaft for varying a distance between the second guide element and the longitudinal axis.

In accordance with another aspect of the invention, a linkage for coupling a piston undergoing reciprocating linear motion along a longitudinal axis to a crankshaft undergoing rotary motion about a rotation axis of the crankshaft includes a guide link having a first end proximal to the piston and coupled to the piston and a second end distal to the piston such that the rotation axis is disposed between the proximal end and the distal end of the guide link. A connecting rod is rotably connected to the end of the guide link distal to the piston at a rod connection point at a connecting end of the connecting rod. The connecting rod is coupled to the crankshaft at a crankshaft connection point on a crankshaft end of the connecting rod, where the crankshaft connection point is offset from the rotation axis of the crankshaft. A guide link guide assembly supports lateral loads at the distal end of the guide link and includes a first roller having a center of rotation fixed with respect to the rotation axis of the crankshaft and a rim in rolling contact with the distal end of the guide link. A spring mechanism is used to urge the rim of the first roller into contact with the distal end of the guide link. The spring mechanism includes a first spring with a first natural frequency of oscillation and a second spring with a second natural frequency of oscillation.

In one embodiment, the guide link guide assembly further includes a second roller in opposition to the first roller and having a center of rotation and a rim in rolling contact with the distal end of the piston. The second roller may include a precision positioner to position the center of rotation of the second roller with respect to the longitudinal axis. In a further embodiment, the precision positioner is a vernier mechanism having an eccentric shaft for varying the distance between the center of rotation of the second roller and the longitudinal axis.

In accordance with yet another aspect of the invention, an improvement is provided to a Stirling cycle machine of the type where at least one piston undergoes reciprocating motion along a longitudinal axis in a cylinder. The piston is coupled to a crankshaft undergoing rotary motion about a rotation axis using a guide link having a first end proximal to the piston and coupled to the piston and a second end distal to the piston. The improvement has a guide link guide assembly including a spring mechanism for urging the rim of a first roller into contact with the distal end of the guide link where the spring mechanism includes a first spring with a first natural frequency of oscillation and a second spring with a second natural frequency of oscillation.

BRIEF DESCRIPTION OF THE DRAWINGS

The invention will be more readily understood by reference to the following description, taken with the accompanying drawings, in which.

DETAILED DESCRIPTION OF PREFERRED EMBODIMENTS

Figure 1C:
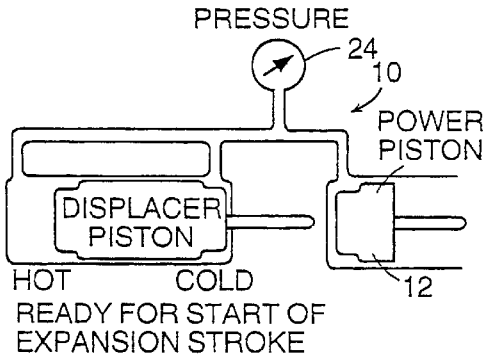
FIG. 1c PRIOR ART
FIGS 1*a*–1*e* depict the principle of operation of a prior art Stirling cycle machine.
Figure 1D:
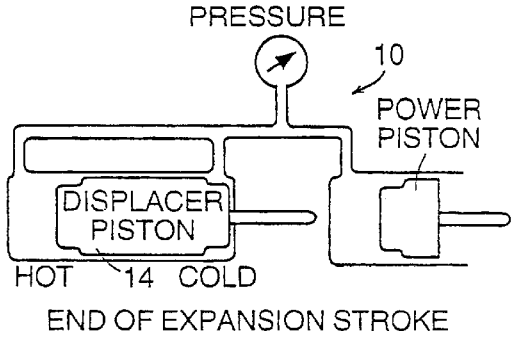
FIG. 1d PRIOR ART
Figure 1E:
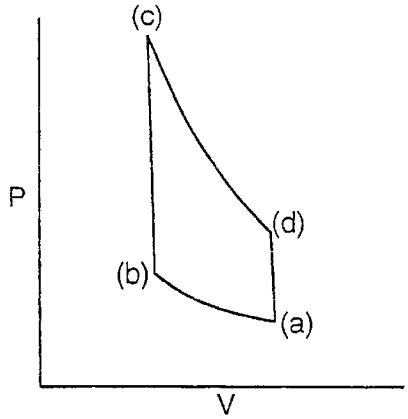
FIG. 1e PRIOR ART
Figure 1B:
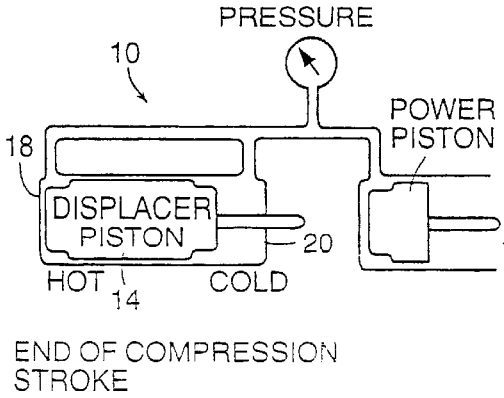
FIG. 1b PRIOR ART
Figure 1A:
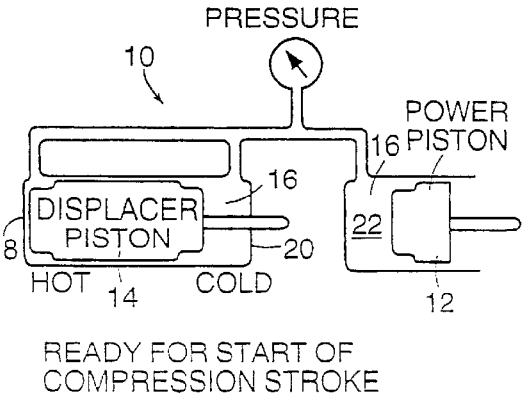
FIG. 1a PRIOR ART
Figure 2:
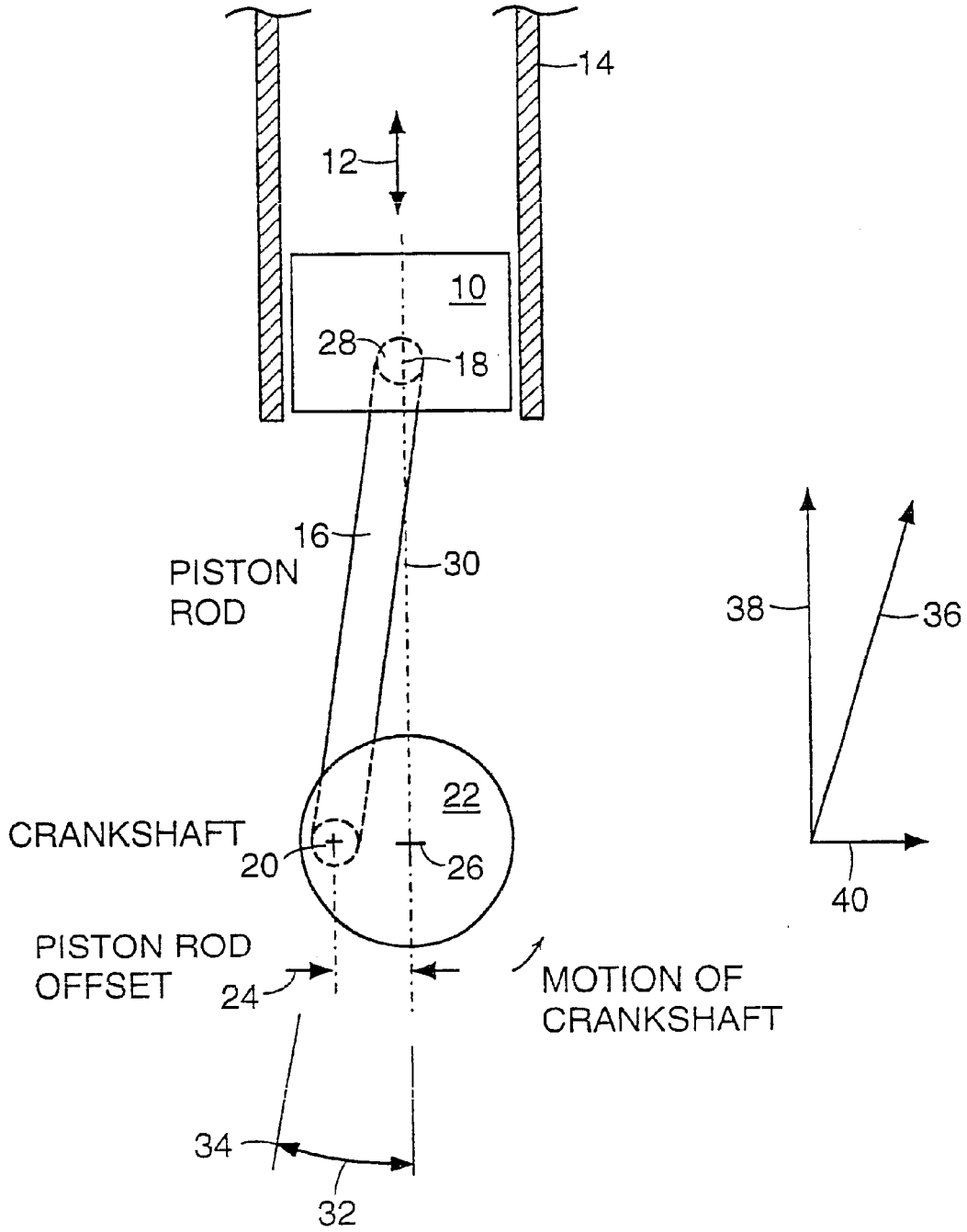
FIG. 2 PRIOR ART
FIG. 2 is a cross-sectional view of a prior art linkage for an engine.
Figure 3:
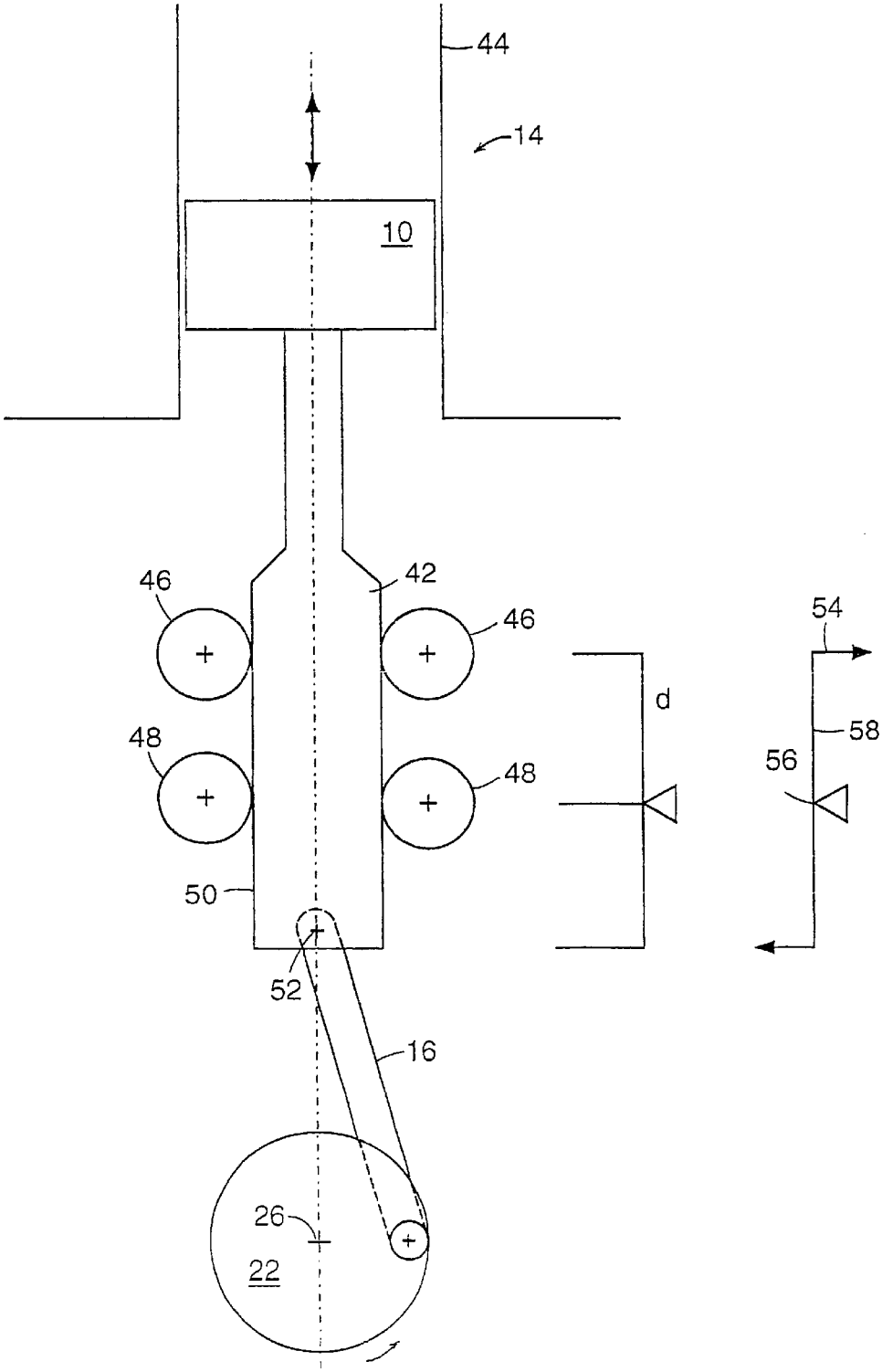
FIG. 3 PRIOR ART
FIG. 3 is a cross-sectional view of a second prior art linkage for an engine, the linkage having a guide link.
Figure 4:
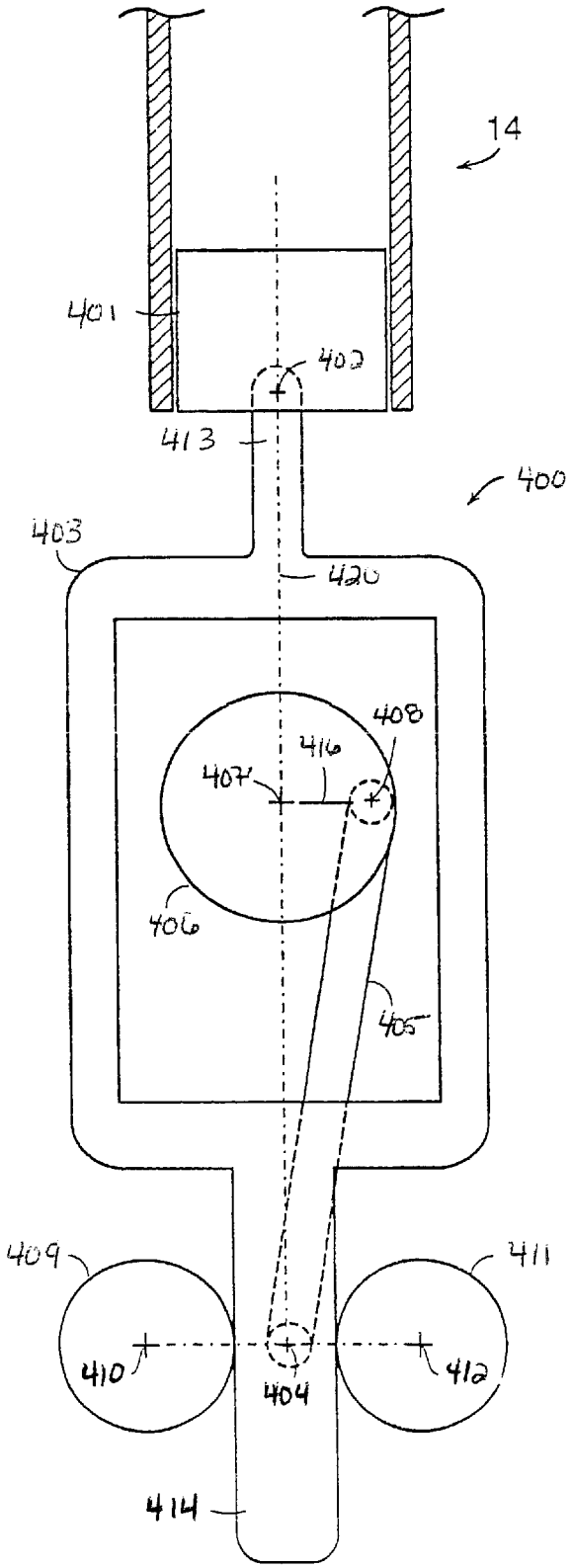
FIG. 4 is a cross-sectional view of a folded guide link linkage for an engine in accordance with a preferred embodiment of the present invention.

Referring now to FIG. 4, a schematic diagram is shown of a folded guide link linkage designated generally by numeral 400. A piston 401 is rigidly coupled to the piston end of a guide link 403 at a piston connection point 402. Guide link 403 is rotatably connected to a connecting rod 405 at a rod connection point 404. The piston connection point 402 and the rod connection point 404 define the longitudinal axis 420 of guide link 403.

Connecting rod 405 is rotatably connected to a crankshaft 406 at a crankshaft connection point 408 which is offset a fixed distance from the crankshaft axis of rotation 407. The crankshaft axis of rotation 407 is orthogonal to the longitudinal axis 420 of the guide link 403 and the crankshaft axis of rotation 407 is disposed between the rod connection point 404 and the piston connection point 402. In a preferred embodiment, the crankshaft axis of rotation 407 intersects the longitudinal axis 420.

An end 414 of guide link 403 is constrained between a first roller 409 and an opposing second roller 411. The centers of roller 409 and roller 411 are designated respectively by numerals 410 and 412. The position of guide link piston linkage 400 depicted in FIG. 4 is that of mid-stroke point in the cycle. This occurs when the radius 416 between the crankshaft connection point 408 and the crankshaft axis of rotation 407 is orthogonal to the plane defined by the crankshaft axis of rotation 407 and the longitudinal axis of the guide link 403. In a preferred embodiment, the rollers 409, 411 are placed with respect to the guide link 403 in such a manner that the rod connection point 404 is in the line defined by the centers 410, 412 of the rollers 409, 411 at mid-stroke. As rollers 409, 411 wear during use, the misalignment of the guide link will increase. In a preferred embodiment, the first roller 409 is spring loaded to maintain rolling contact with the guide link 403. In accordance with embodiments of the invention, guide link 403 may comprise subcomponents such that the portion 413 of the guide link proximal to the piston may be a lightweight material such as aluminum, whereas the "tail" portion 414 of the guide link distal to the piston may be a durable material such as steel to reduce wear due to friction at rollers 409 and 411.

Alignment of the longitudinal axis 420 of the guide link 403 with respect to piston cylinder 14 is maintained by the rollers 409, 411 and by the piston 401. As crankshaft 406 rotates about the crankshaft axis of rotation 407, the rod connection point 404 traces a linear path along the longitudinal axis 420 of the guide link 403. Piston 401 and guide link 403 form a lever with the piston 401 at one end of the lever and the rod end 414 of the guide link 403 at the other end of the lever. The fulcrum of the lever is on the line defined by the centers 410, 412 of the rollers 409, 411. The lever is loaded by a force applied at the rod connection point 404. As rod connection point 404 traces a path along the longitudinal axis of the guide link 403, the distance between the rod connection point 404 and the fulcrum, the first lever arm, will vary from zero to one-half the stroke distance of the piston 401. The second lever arm is the distance from the fulcrum to the piston 401. The lever ratio of the second lever arm to the first lever arm will always be greater than one, preferably in the range from 5 to 15. The lateral force at the piston 401 will be the forced applied at the rod connection point 404 scaled by the lever ratio; the larger the lever ratio, the smaller the lateral force at the piston 401.

By moving the connection point to the side of the crankshaft axis distal to that of the piston, the distance between the crankshaft axis and the piston cylinder does not have to be increased to accommodate the roller housing. Additionally, only one set of rollers is required for aligning the piston, thereby advantageously reducing the size of the roller housing and the overall size of the engine. In accordance with the invention, while the piston experiences a non-zero lateral force (unlike a standard guide link design where the lateral force of a perfectly aligned piston is zero), the lateral force can be at least an order of magnitude less than that experienced by a simple connecting rod crankshaft arrangement due to the large lever arm created by the guide link.

Lateral forces on a piston can give rise to noise and to wear. As mentioned above, roller 409 and roller 411 are used to align the piston 401 and to take up lateral forces being transmitted to the guide link 403 by the connecting rod 405. Preferably, one of the rollers 409 is spring loaded to maintain rolling contact with the guide link 403. At least one spring may be used to force the roller 409 (otherwise referred to herein as a guide wheel) against the guide link 403 surface. During operation of an engine, the guide wheel 409 and spring mechanism will typically reciprocate or bounce on the surface of the guide link 403 at or near the natural resonant frequency of the guide wheel and spring combination. This oscillation may result in significant fluctuations in the force supporting the guide link 403 as well as intermittent contact between the guide link 403 and the guide wheel 409. This, in turn, results in excessive noise, increased wear and decreased efficiency and power output.

Figure 5:
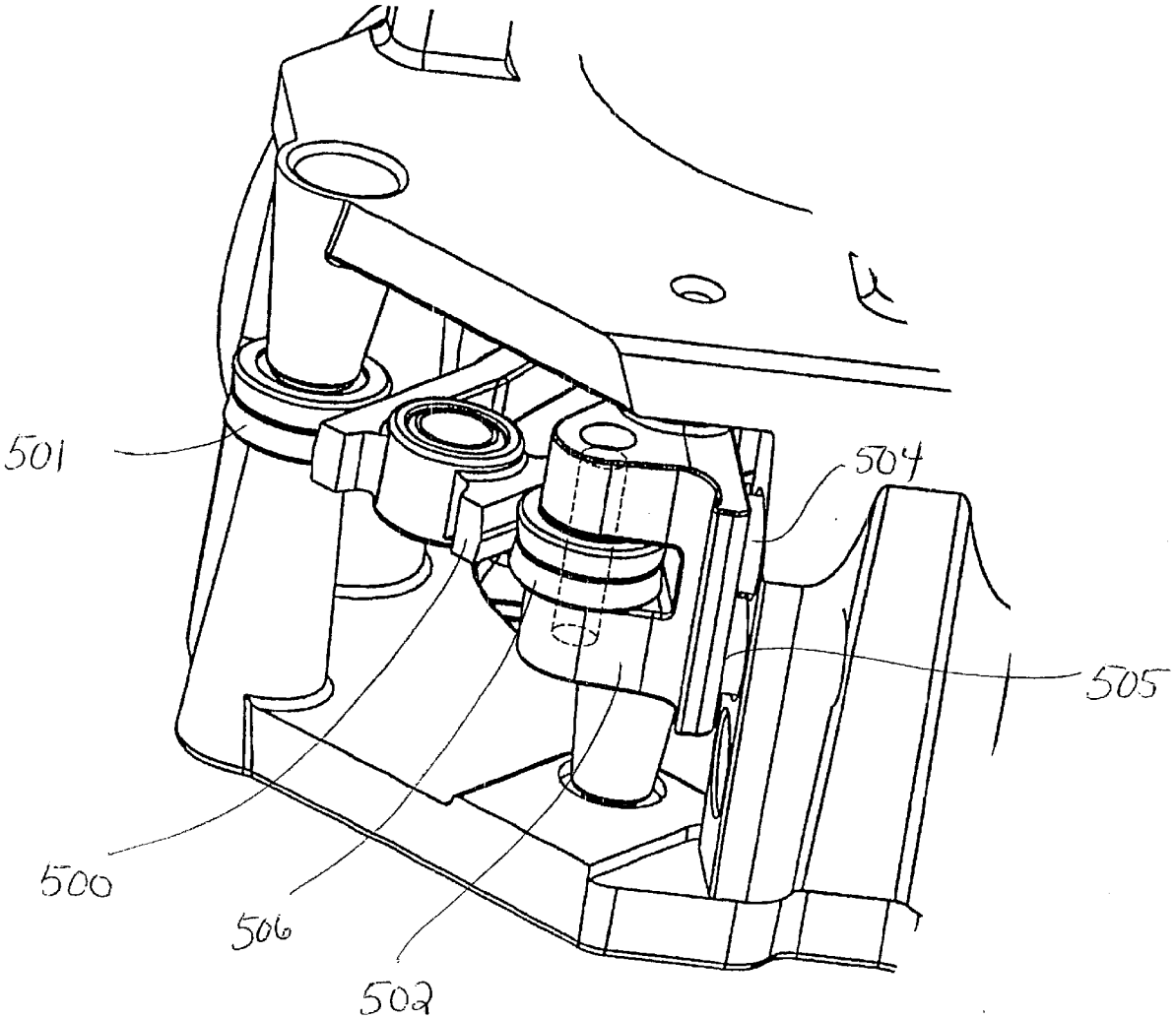
FIG. 5 is a perspective view of a guide link and guide wheel assembly in accordance with an embodiment of the invention.

FIG. 5 is a perspective view of a guide link and guide wheel assembly in accordance with an embodiment of the invention. In FIG. 5, a guide link 500 is supported at its free end by a fixed guide wheel 501 and a spring loaded guide wheel assembly 502. The guide wheel assembly 502 includes two springs 504, 505 and a guide wheel 506. Springs 504 and 505 force the guide wheel 506 against the guide link 500. Springs 504 and 505 have the combined force necessary to hold the guide wheel assembly 502 in contact with guide link 500. In addition, spring 504 and spring 505 each have a different natural frequency of oscillation (i.e., each has a different spring rate). By selecting springs with non-overlapping natural frequencies, at least one spring will advantageously not be in resonance at all times during operation. As mentioned above, the guide wheel assembly 502 will typically reciprocate on the surface of the guide link 500 at or near the natural resonant frequency of the guide wheel and springs. By using two springs with different natural frequencies of oscillation, the resonance of the guide wheel assembly 502 should be eliminated since at least one spring will not be in resonance.

Figure 6A:
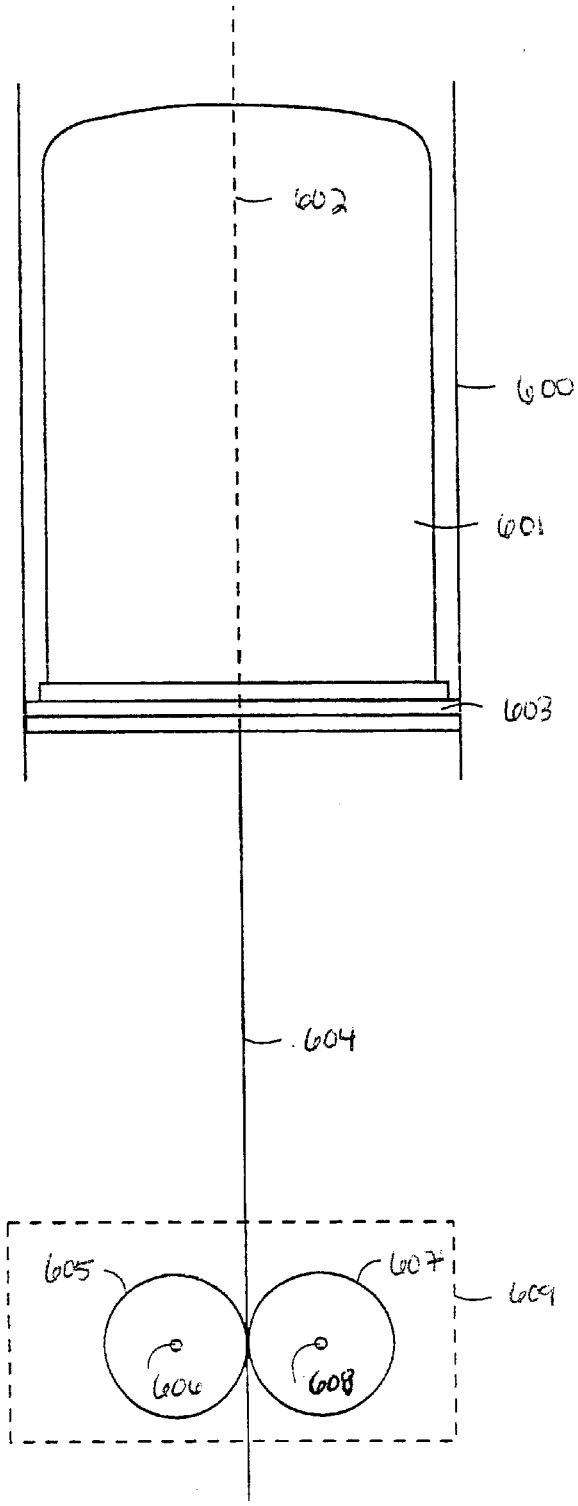
FIG. 6*a* is a cross-sectional view of a piston and guide assembly for allowing the precision alignment of piston motion using vernier alignment in accordance with a preferred embodiment of the invention.

Additional friction may be generated by the misalignment of the piston in the cylinder. A solution to the alignment problem is now discussed with reference to FIGS. 6*a*–6*e*. FIG. 6*a* shows a schematic diagram of a piston 601 and a guide assembly 609 for allowing precision alignment of piston motion using vernier alignment in accordance with a preferred embodiment of the invention. The piston 601 executes a reciprocating motion along a longitudinal axis 602 in cylinder 600. A guide link 604 is coupled to the piston 601. An end of the guide link 604 is constrained between a first roller 605 and an opposing second roller 607. The centers of roller 605 and roller 607 are designated respectively by numerals 606 and 608. A piston guide ring 603 may be used at one end of the piston 601 to prevent piston 601 from touching the cylinder 600. However, if piston 601 is not aligned to move in a straight line along longitudinal axis 602, it is possible other points along the length of piston 601 not coupled to the guide ring may contact the cylinder 600. In a preferred embodiment, piston 601 is aligned using rollers 605 and 607 and guide link 604 such that piston 601 moves along the longitudinal axis 602 in a straight line and is substantially centered with respect to cylinder 600.

In accordance with a preferred embodiment of the invention, the piston 601 may be aligned with respect to the piston cylinder 600 by adjusting the position of the center 608 of the second roller 607. The first roller 605 is spring loaded to maintain rolling contact with the guide link 604. The second roller 607 is mounted on an eccentric flange such that rotation of the flange causes the second roller 607 to move laterally with respect to longitudinal axis 602. A single pin (not shown) may be used to secure the second roller 607 into a position. The movement of the second roller 607 will cause the guide link 604 and the piston 601 to also move laterally with respect to the longitudinal axis 602. In this manner, the piston 601 may be aligned so as to move in cylinder 600 in a straight line that is substantially centered with respect to cylinder 600.

Figure 6B:
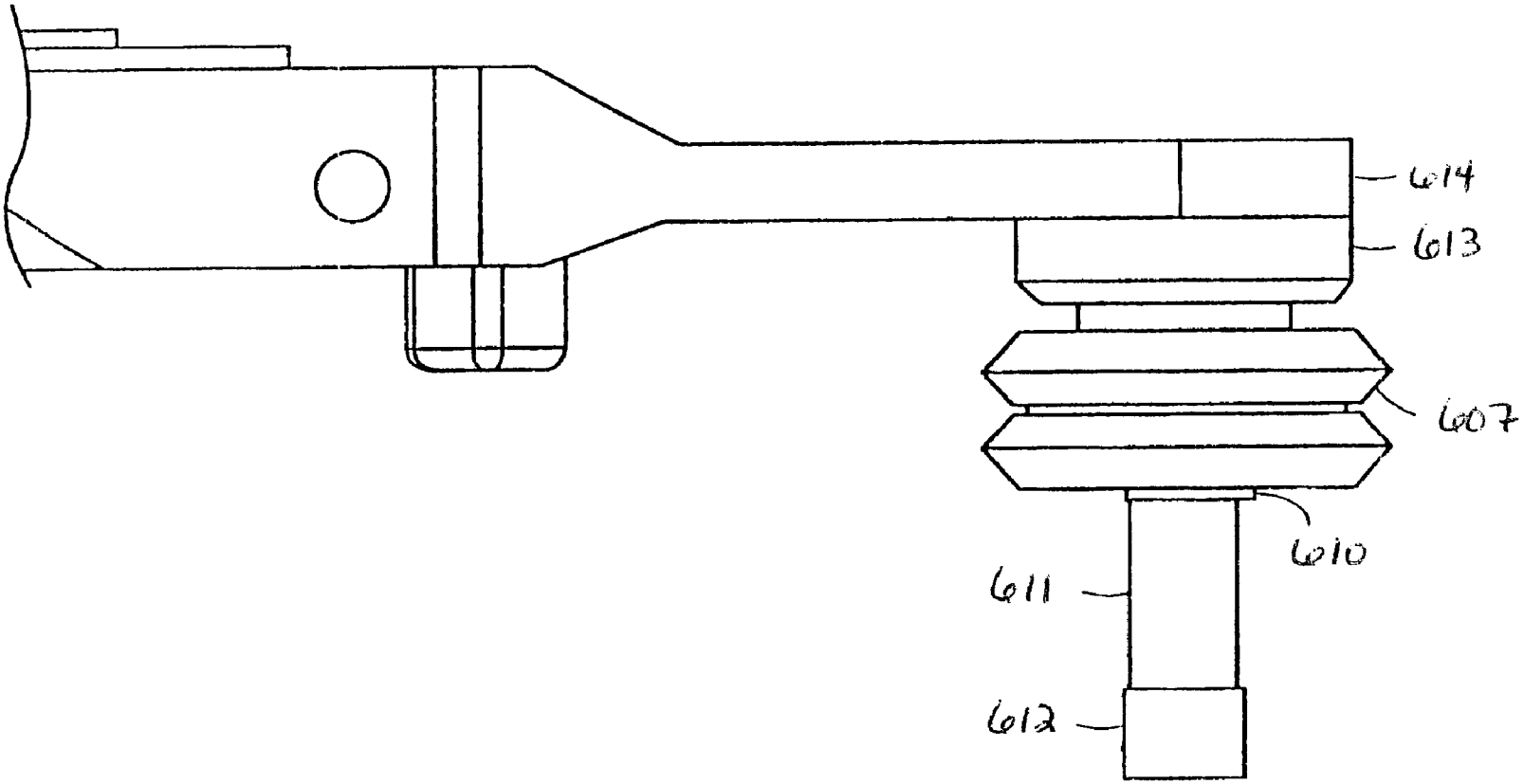
FIG. 6*b* is a side view of the precision alignment mechanism in accordance with an embodiment of the invention.
Figure 6C:
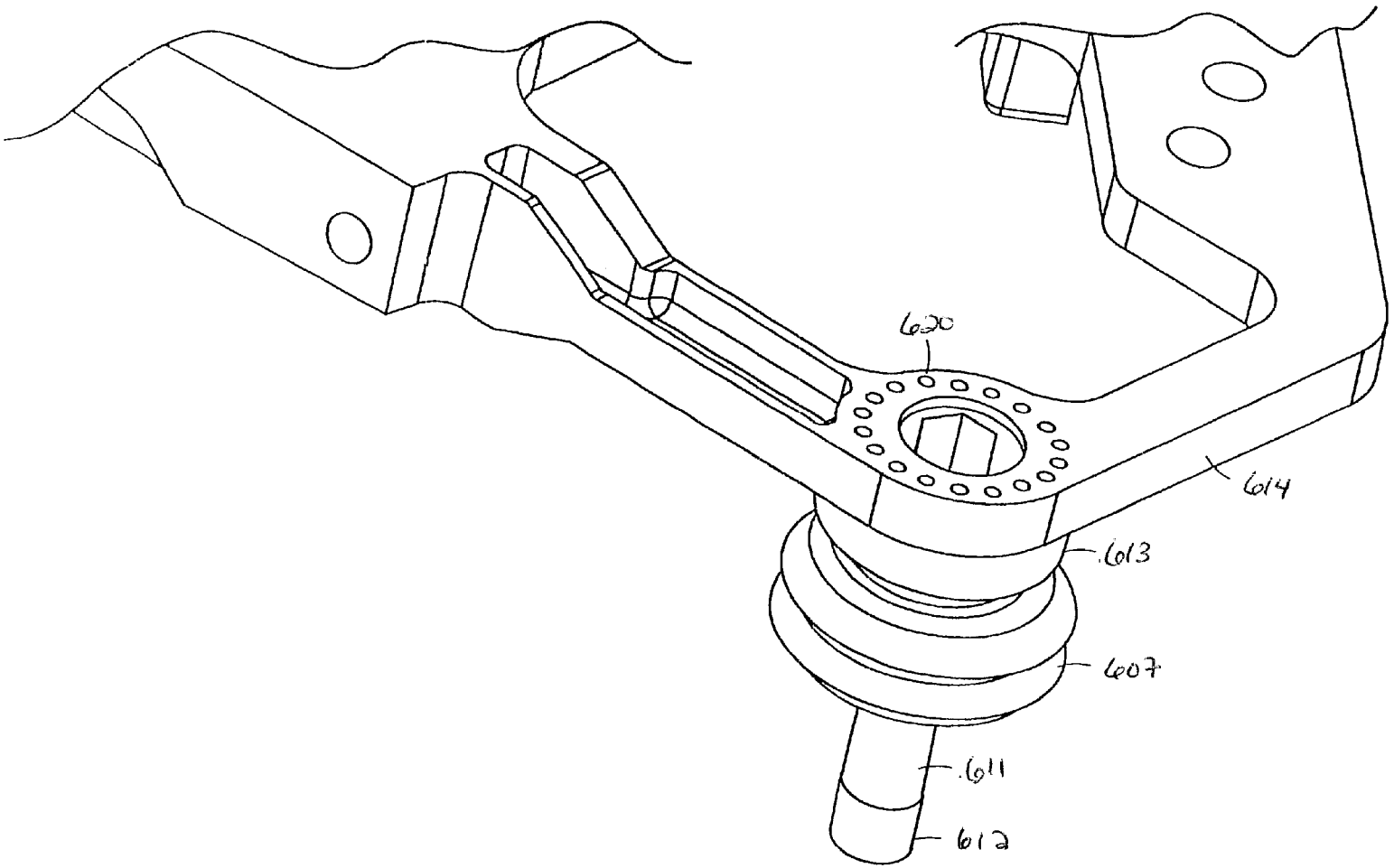
FIG. 6*c* is a perspective view of the precision alignment mechanism of FIG. 6*b* in accordance with an embodiment of the invention.

FIG. 6*b* shows a side view of one embodiment of a precision alignment mechanism. A roller 607 is rotatably mounted on a locking eccentric 611 having a lower end 612 and an upper end 613. The roller is mounted on a portion 610 of the locking eccentric 611 having a roller axis of rotation that is offset from the axis of rotation of the locking eccentric 611. The lower end 612 is rotatably mounted in a lower bracket (not shown). The upper end 613 is rotatably mounted on an upper bracket 614. FIG. 6*c* shows a perspective view of the embodiment shown in FIG. 6*b*. The upper bracket 614 has a plurality of bracket holes 620 drilled through the upper bracket 614. In a preferred embodiment, eighteen bracket holes are drilled through the upper bracket 614. The bracket holes 620 are offset a distance from the axis of rotation of the locking eccentric 611 and are evenly spaced around the circumference defined by the offset distance.

Figure 6D:
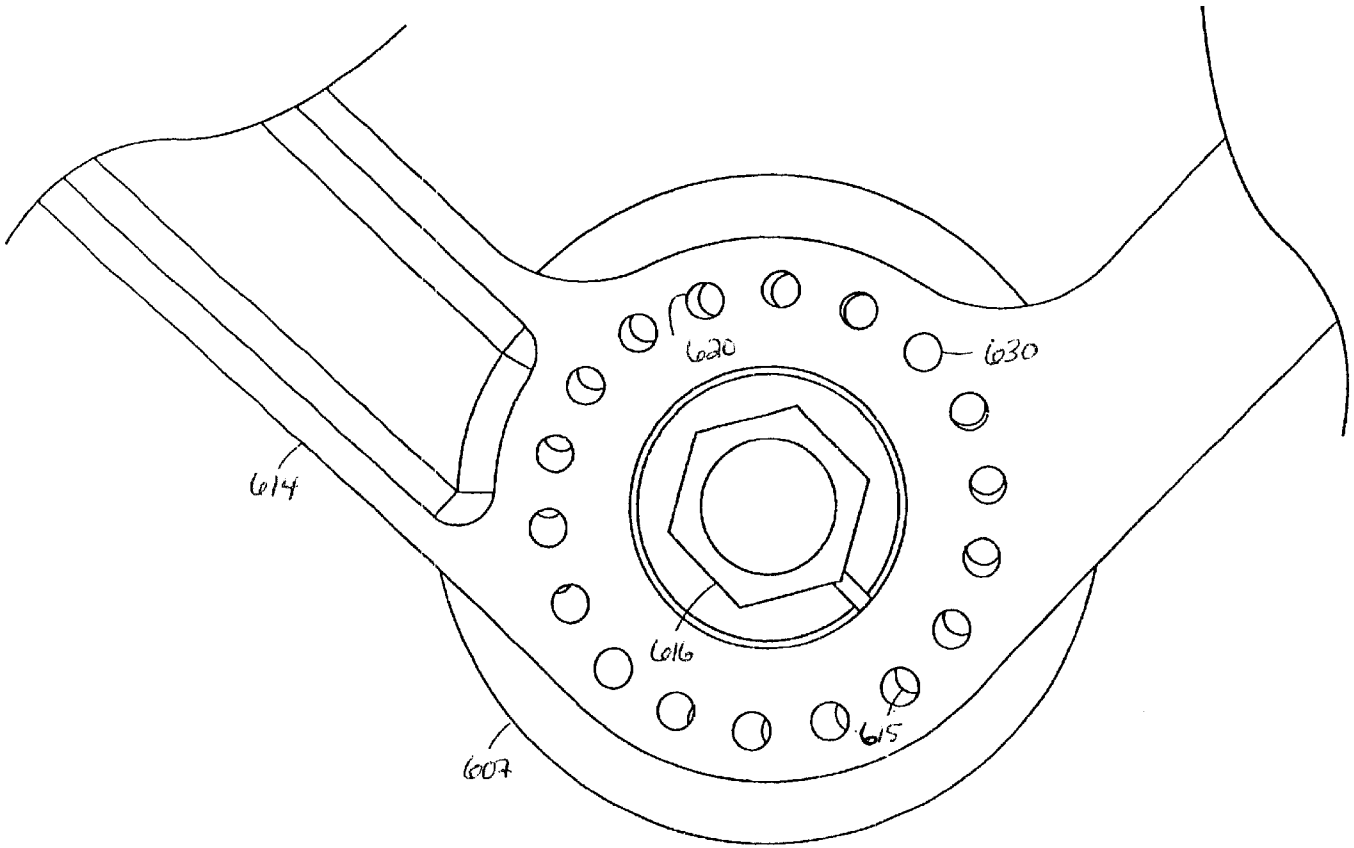
FIG. 6*d* is a top view of the precision alignment mechanism of FIG. 6*b* in accordance with an embodiment of the invention.
Figure 6E:
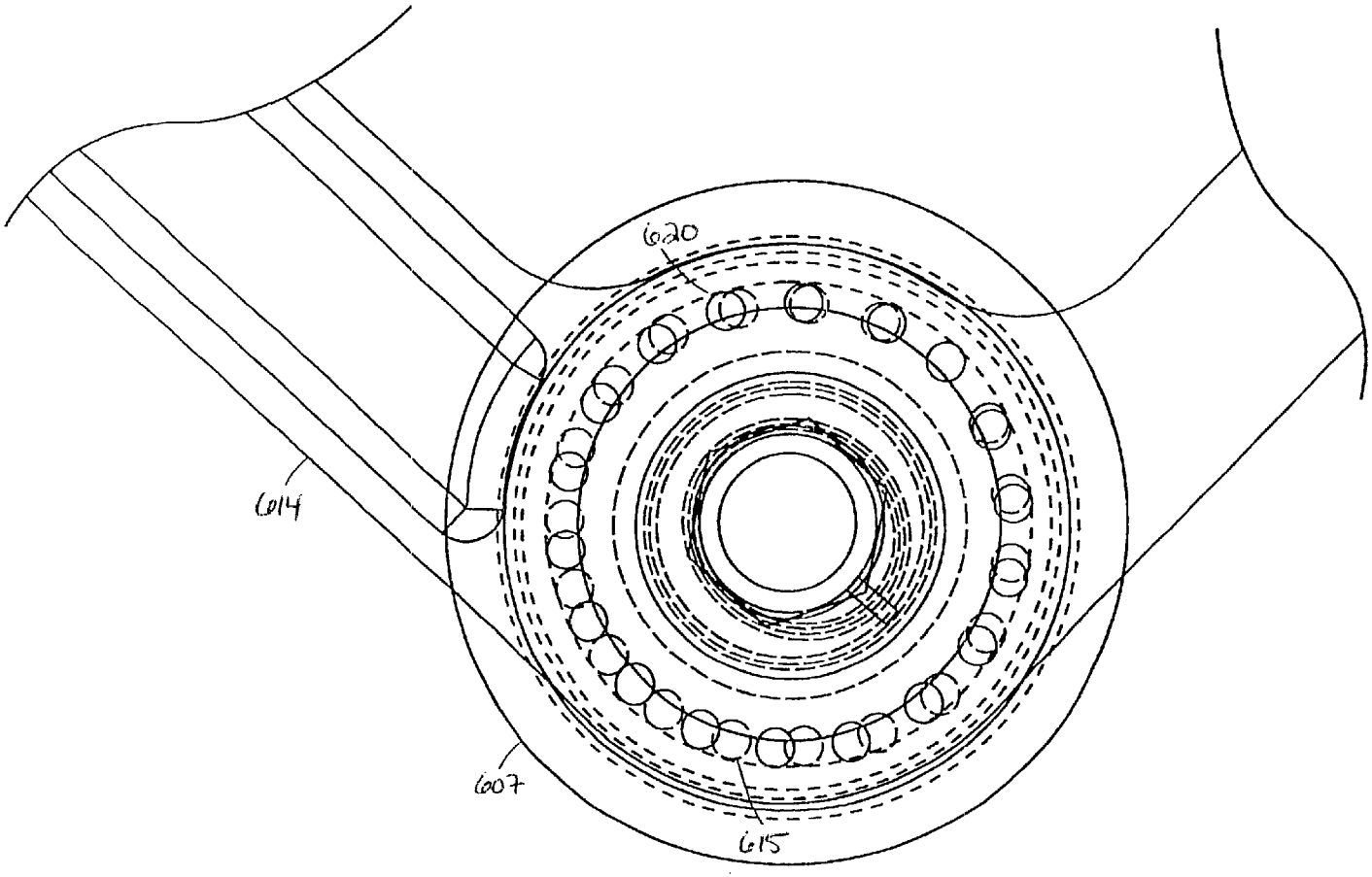
FIG. 6*e* is a top view of the precision alignment mechanism of FIG. 6*b* with both the locking holes and the bracket holes showing in accordance with an embodiment of the invention.

FIG. 6*d* shows a top view of the embodiment shown in FIG. 6*b*. The upper end 613 of the locking eccentric 611 has a plurality of locking holes 615. The number of locking holes 615 should not be identical to the number of bracket holes 620. In a preferred embodiment, the number of locking holes 615 is nineteen. The locking holes 615 are offset from the axis of rotation of the locking eccentric 611 by the same distance used to offset the bracket holes 620. The locking holes 615 are evenly spaced around the circumference defined by the offset distance. FIG. 6*d* also shows a locking nut 616 that allows the locking eccentric 611 to rotate when the locking nut 616 is loose. When the locking nut 616 is tightened, the locking nut 616 makes a rigid connection between the locking eccentric 611 and the upper bracket 614. FIG. 6*e* is the same view as shown in FIG. 6*d* but with the locking holes 615 shown.

During assembly, the piston is aligned in the following manner. The folded guide link is assembled with the locking nut 616 in a loosened state. The piston 601 (FIG. 6*a*) is aligned within the piston cylinder 600 (FIG. 6*a*) visually by rotating the locking eccentric 611. As the locking eccentric 611 is rotated, the roller axis of rotation 608 (FIG. 6*a*) will be displaced both laterally and longitudinally to the guide link longitudinal axis 602 (FIG. 6*a*). The large lever ratio of the present invention requires only a very small displacement of the roller axis of rotation 608 (FIG. 6*a*) with respect to the longitudinal axis 602 (FIG. 6*a*) to align the piston 601 (FIG. 6*a*) within the piston cylinder 600 (FIG. 6*a*). In accordance with an embodiment of the invention, the maximum displacement range may be from 0.000 inches to 0.050 inches. In a preferred embodiment, the maximum displacement is between 0.010 inches and 0.030 inches. As the locking eccentric 611 is rotated, one of the locking holes 615 will align with a bracket hole 620. FIG. 6*d* indicates such an alignment 630. Once the piston 601 (FIG. 6*a*) is aligned in the piston cylinder 600 (FIG. 6*a*), a pin (not shown) is inserted through the aligned bracket hole and into the aligned locking hole thereby locking the locking eccentric 611. The locking nut 616 is then tightened to rigidly connect the upper bracket 614 to the locking eccentric 611.

Figure 7:
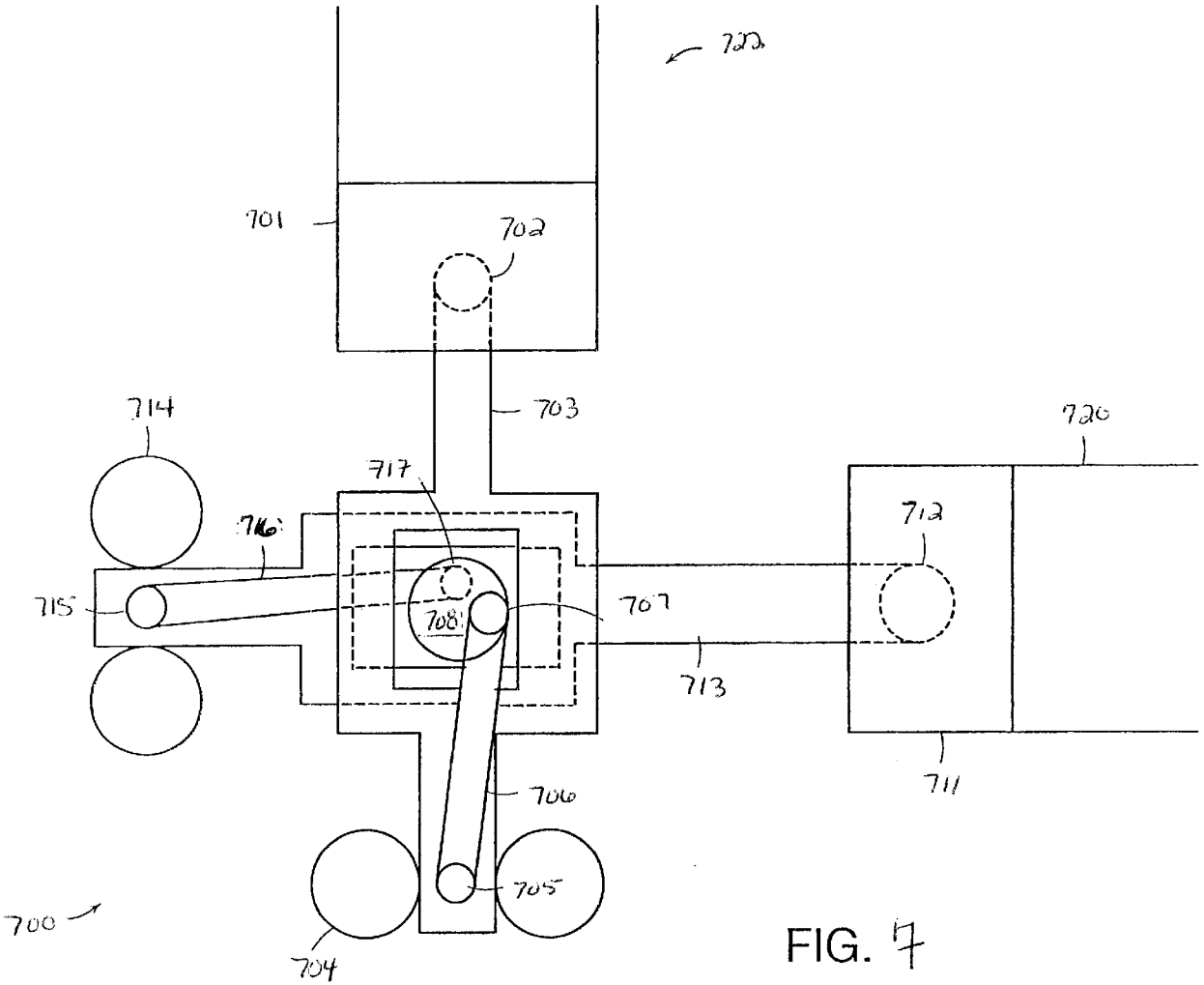
FIG. 7 is a cross-sectional view of a folded guide link linkage for a two-piston machine such as a Stirling cycle machine in accordance with a preferred embodiment of the present invention.

In accordance with a preferred embodiment of the invention, a dual folded guide link piston linkage such as shown in cross-section in FIG. 7 and designated there generally by numeral 700 may be incorporated into a compact Stirling engine. Referring now to FIG. 7, pistons 701 and 711 are the displacer and compression pistons, respectively, of a Stirling cycle engine. As used in this description and the following claims, a displacer piston is either a piston without a seal or a piston with a seal (commonly known as an "expansion" piston). The Stirling cycle is based on two pistons executing reciprocating linear motion about 90° out of phase with one another. This phasing is achieved when the pistons are oriented at right angles and the respective connecting rods share a common pin of a crankshaft. Additional advantages of this orientation include reduction of vibration and noise. Additionally, the two pistons may advantageously lie in the same plane to eliminate shaking vibrations orthogonal to the plane of the pistons. While the invention is described generally with reference to the Stirling engine shown in FIG. 7, it is to be understood that many engines as well as refrigerators may similarly benefit from various embodiments and improvements which are subjects of the present invention.

Figure 8:
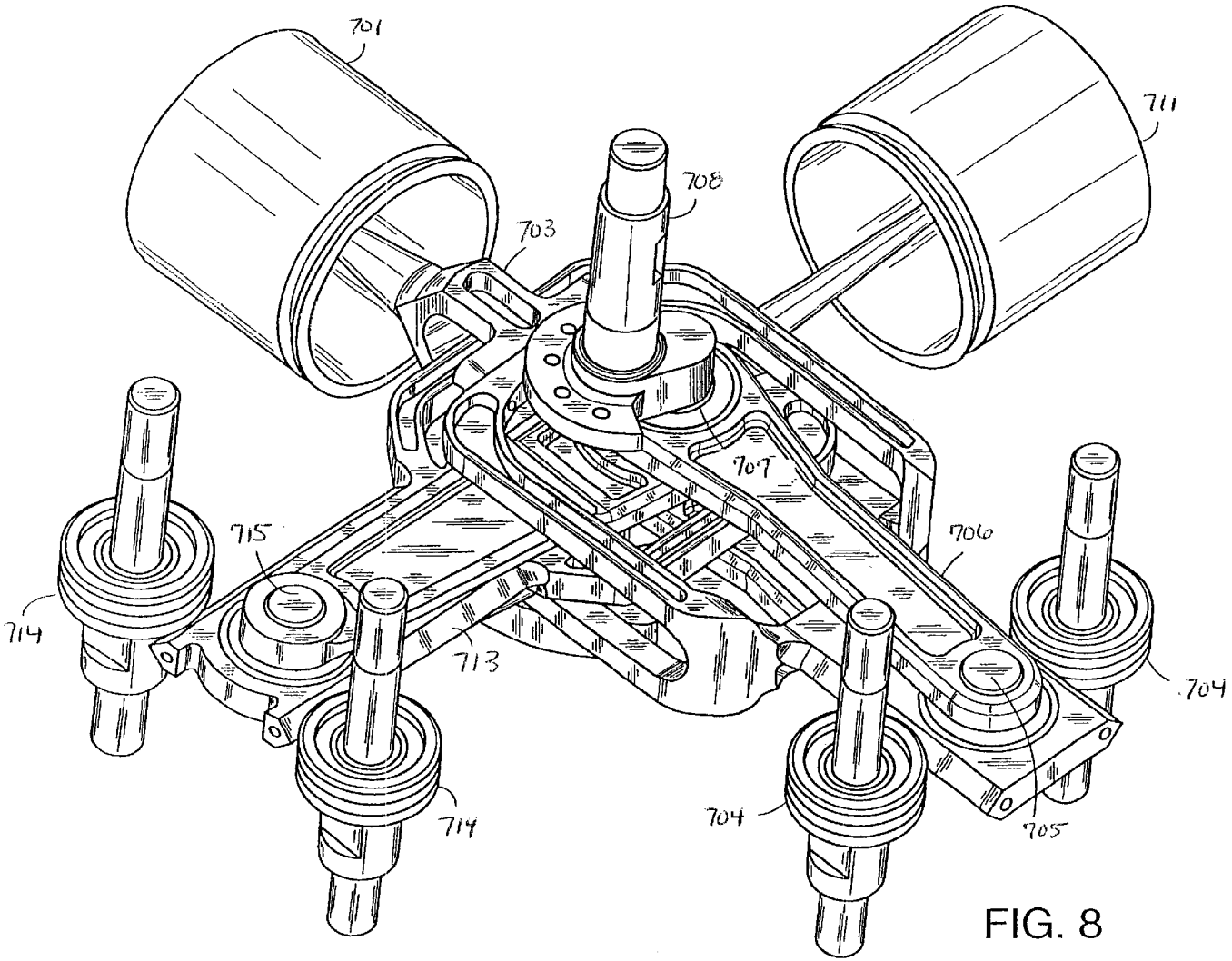
FIG. 8 is a perspective view of one embodiment of the dual folded guide link linkage of FIG. 7.

The configuration of a Stirling engine shown in FIG. 7 in cross-section, and in perspective in FIG. 8, is referred to as an alpha configuration, characterized in that compression piston 711 and displacer piston 701 undergo linear motion within respective and distinct cylinders: compression piston 711 in compression cylinder 720 and displacer piston 701 in expansion cylinder 722. Guide link 703 and guide link 713 are rigidly coupled to displacer piston 701 and compression piston 711 at piston connection points 702 and 712 respectively. Connecting rods 706 and 716 are rotationally coupled at connection points 705 and 715 of the distal ends of guide links 703 and 713 and to crankshaft 708 at crankshaft connection points 707 and 717. Lateral loads on guide links 703 and 713 are substantially taken up by roller pairs 704 and 714. As discussed above with respect to FIGS. 4 and 6, the pistons 701 and 711 may be aligned within the cylinders 720 and 722 respectively such using precision alignment of roller pairs 704 and 714.

The devices and methods described herein may be applied in other applications besides the Stirling engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

We claim:

1. A system for supporting lateral loads on a piston undergoing reciprocating motion along a longitudinal axis in a cylinder, the piston coupled to a guide link having a length and for coupling the piston to a crankshaft undergoing rotary motion about a rotation axis of the crankshaft, the longitudinal axis and the rotation axis being substantially orthogonal to each other, the system comprising:

a first guide element located along the length of the guide link, the first guide element having a spring mechanism for urging the first guide element into contact with the guide link, the spring mechanism having a first spring with a first natural frequency of oscillation and a second spring with a second natural frequency of oscillation; and a second guide element in opposition to the first guide element.

2. A system according to claim 1, wherein the first guide element is a roller having a rim in rolling contact with the guide link and the second guide element is a roller with a rim in rolling contact with the guide link.

3. A system according to claim 1, wherein the second guide element includes a precision positioner for positioning the second guide element with respect to the longitudinal axis.

4. A device according to claim 3, wherein the precision positioner is a vernier mechanism having an eccentric shaft for varying a distance between the second guide element and the longitudinal axis.

5. A linkage for coupling a piston undergoing reciprocating linear motion along a longitudinal axis to a crankshaft undergoing rotary motion about a rotation axis of the crankshaft, the longitudinal axis and the rotation axis being substantially orthogonal to each other, the linkage comprising:

a guide link having a first end proximal to the piston, the first end coupled to the piston, and having a second end distal to the piston such that the rotation axis is disposed between the proximal end and the distal end of the guide link;

a connecting rod having a connecting end and a crankshaft end, the connecting end rotatably connected to the end of the guide link distal to the piston at a rod connection point and the crankshaft end coupled to the crankshaft at a crankshaft connection point offset from the rotation axis of the crankshaft; and a guide link guide assembly for supporting lateral loads at the distal end of the guide link, the guide link assembly including:

a. a first roller having a center of rotation fixed with respect to the rotation axis of the crankshaft and a rim in rolling contact with the distal end of the guide link; and b. a spring mechanism for urging the rim of the first roller into contact with the distal end of the guide link, the spring mechanism having a first spring with a first natural frequency of oscillation and a second spring with a second natural frequency of oscillation.

6. A linkage according to claim 5, wherein the guide link guide assembly further includes a second roller in opposition to the first roller, the second roller having a center of rotation and a rim in rolling contact with the distal end of the guide link.

7. A linkage according to claim 6, wherein the second roller further includes a precision positioner to position the center of rotation of the second roller with respect to the longitudinal axis.

8. A linkage according to claim 7, wherein the precision positioner is a vernier mechanism having an eccentric shaft for varying the distance between the center of rotation of the second roller and the longitudinal axis.

9. In a Stirling cycle machine of the type wherein at least one piston undergoes reciprocating motion along a longitudinal axis in a cylinder, the piston coupled to a crankshaft undergoing rotary motion about a rotation axis using a guide link having a first end proximal to the piston and coupled to the piston and a second end distal to the piston, the improvement comprising:

a guide link guide assembly in contact with the distal end of the guide link and for supporting lateral loads at the distal end of the guide link, the guide link guide assembly including:

a. a first roller having a center of rotation fixed with respect to the rotation axis of the crankshaft and a rim in rolling contact with the distal end of the guide link; and b. a spring mechanism for urging the rim of the first roller into contact with the distal end of the guide link, the spring mechanism having a first spring with a first natural frequency of oscillation and a second spring with a second natural frequency of oscillation.

10. In a Stirling cycle machine according to claim 9, wherein the guide link guide assembly further includes a second roller in opposition to the first roller, the second roller having a center of rotation and a rim in rolling contact with the distal end of the guide link.

11. In a Stirling cycle machine according to claim 10, wherein the second roller further includes a precision positioner to position the center of rotation of the second roller with respect to the longitudinal axis.

12. In a Stirling cycle machine according to claim 11, wherein the precision positioner is a vernier mechanism having an eccentric shaft for varying a distance between the center of rotation of the second roller and the longitudinal axis.

* * * * *